United States Patent [19]

Leonard et al.

[11] 4,153,538

[45] May 8, 1979

[54] USE OF DEASHED COAL AS A FLUSHING AGENT IN A COAL DEASHING PROCESS

[75] Inventors: Robert E. Leonard; Donald E. Rhodes, both of Oklahoma City, Okla.

[73] Assignee: Kerr-McGee Corporation, Oklahoma City, Okla.

[21] Appl. No.: 888,299

[22] Filed: Mar. 20, 1978

[51] Int. Cl.[2] ..... C10G 21/14

[52] U.S. Cl. ..... 208/177

[58] Field of Search ..... 208/177, 8

[56] References Cited

U.S. PATENT DOCUMENTS

| | | | |
|---|---|---|---|
| 2,608,526 | 8/1952 | Rex | 208/8 |
| 2,741,549 | 4/1956 | Russell | 208/8 |
| 3,129,164 | 4/1964 | Cameron | 208/8 |
| 3,644,192 | 2/1972 | Li et al. | 208/8 |
| 3,748,254 | 7/1973 | Gorin | 208/8 |
| 3,947,346 | 3/1976 | Snell et al. | 208/8 |

*Primary Examiner*—George Crasanakis

*Attorney, Agent, or Firm*—William G. Addison

[57] ABSTRACT

A process for maintaining the fluid-like properties of a heavy phase being withdrawn from a separation zone maintained at elevated temperature and pressure during periods in which the flow of this heavy phase is terminated due to pressure reduction valve plugging or to permit cleaning of downstream processing apparatus. When the flow of withdrawn heavy phase is interrupted, deashed coal is melted, if necessary, and introduced under pressure into the withdrawal conduit to mix with the heavy phase therein. The mixture of deashed coal and heavy phase retains the fluid-like properties exhibited by the heavy phase and flow can be resumed once the downstream apparatus is repaired. Alternatively, other high-boiling aromatic materials may be used instead of the deashed coal.

6 Claims, 1 Drawing Figure

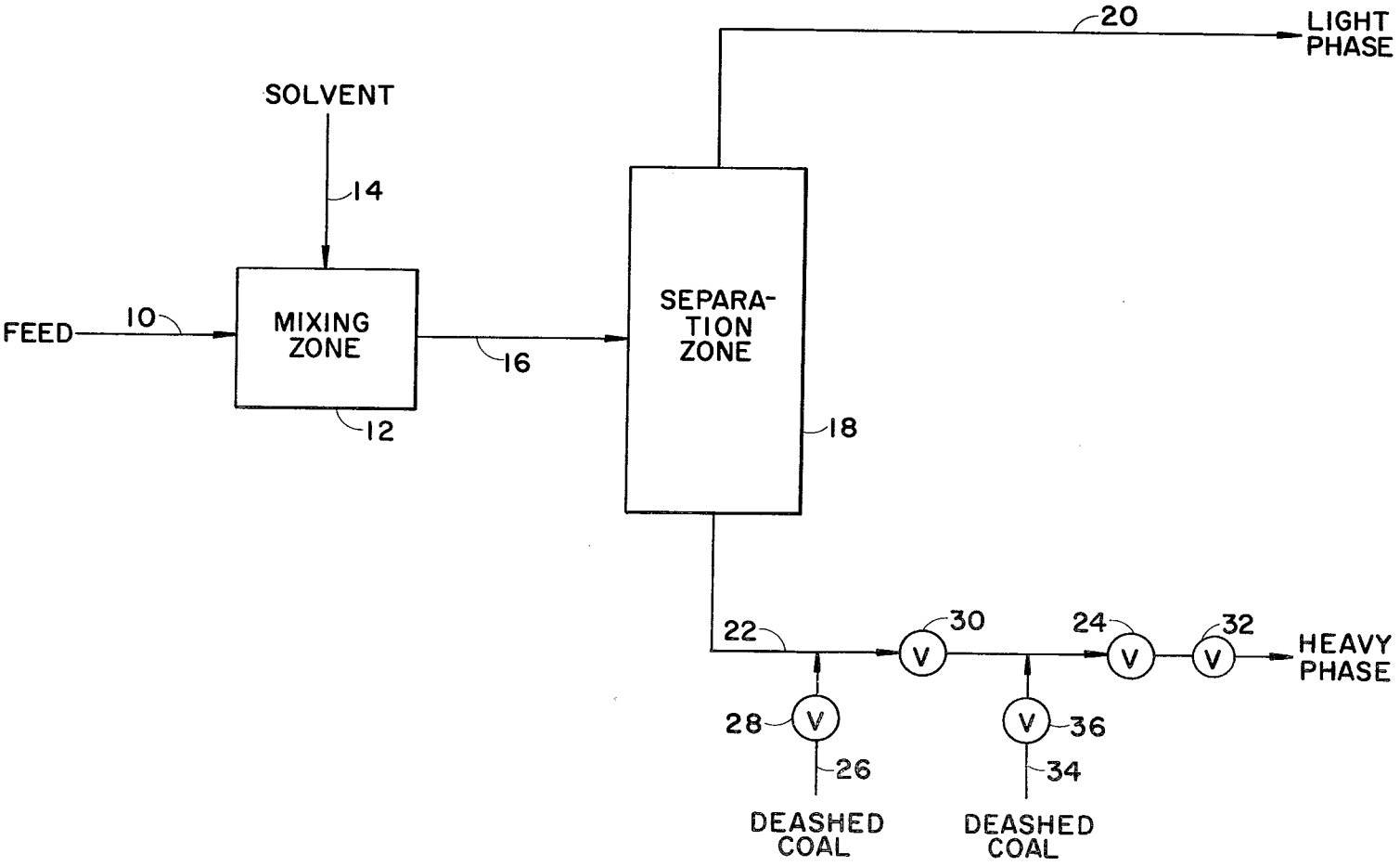
FEED
10
MIXING ZONE
12
SOLVENT
14
16
SEPARA-TION ZONE
18
20
LIGHT PHASE
22
28
DEASHED COAL
26
30
36
34
DEASHED COAL
24
32
HEAVY PHASE

USE OF DEASHED COAL AS A FLUSHING AGENT IN A COAL DEASHING PROCESS

CROSS-REFERENCE TO RELATED APPLICATIONS

The subject matter of this application relates to copending application Ser. No. 887,870 entitled "A Process For Improved Operation Of A Continuous Coal Deashing Process" filed of even date herewith.

BACKGROUND OF THE INVENTION

1. Field of the Invention

This invention relates to a process by which improved operation of a continuous coal deashing process can be effected, and more particularly but not by way of limitation, to a process for maintaining the fluidity of fluid-like phases formed during the deashing process.

2. Description of the Prior Art

Various coal deashing processes have been developed in the past wherein coal has been treated with one or more solvents and processed to separate the resulting insoluble coal products from the soluble coal products.

U.S. Pat. Nos. 3,607,716 and 3,607,717 assigned to the same assignee as the present invention describe processes wherein coal liquefaction products are contacted with a solvent and the resulting mixture is introduced into a separation zone maintained at elevated temperature and pressure and separated into a heavy phase containing the insoluble coal products and a light phase containing the soluble coal products. In such processes, the light phase is withdrawn from the separation zone and passed to downstream fractionating vessels wherein the soluble coal products are separated into multiple fractions. One means of removing the heavy phase from the elevated temperature and pressure separation zone is to withdraw the material through a conduit in which a pressure reduction valve is positioned.

The separation is effected in these processes by maintaining rigorous control of the process conditions. The failure to maintain the required conditions often will cause the process to become inoperable.

In the event the process conditions are not maintained, the heavy phase, which exhibits fluid-like properties under the operating conditions of the process, begins to solidify into a solid mass upon the interior surfaces of the apparatus comprising the separation zone. Once formed, the solidified mass will not regain the fluid-like properties formerly exhibited by the heavy phase upon a return of the process conditions to their former limits. The solidified mass, when formed in small amounts, exhibits a tendency to spall away from the surfaces of the separation apparatus and settle within the heavy phase within the apparatus. When the heavy phase is withdrawn from the separation zone, the solid fragments therein can cause the pressure reduction valve interposed in the withdrawal conduit to plug or other downstream apparatus can be plugged. If plugging occurs, process operation must be terminated until the plugged apparatus can be removed, cleaned and reinstalled.

In practice, it has been found that if the process apparatus is depressurized and cooled to permit cleaning of plugged apparatus while the heavy phase is permitted to remain within the apparatus, it is not possible to return the heavy phase to its previous fluid-like condition by reheating and repressurizing the process apparatus.

Further, when attempts have been made to isolate, for example, a plugged pressure reduction valve with block valves to permit cleaning of the plugged valve without depressurization of the process apparatus, it is not possible to return to normal operation merely by reopening the closed block vlaves. It is found that upon reopening the valves, solvent flashes from the heavy phase and the heavy phase becomes a solid mass which replugs the pressure reduction valve. In addition, injection of an inert gas, such as nitrogen, at system pressure into the conduit between the block valve and the pressure reduction valve, before reopening the block valve, is not successful in preventing immediate replugging of the pressure reduction valve upon an attempt to resume normal operation.

It would be desirable to provide a means by which the previously described coal deashing processes can be maintained at operating conditions and the heavy phase can be retained in its fluid-like condition while problems causing interruption of the flow of withdrawn heavy phase are corrected.

SUMMARY OF THE INVENTION

It now has been discovered that the deashed coal recovered as a product of the separated light phase withdrawn from the separation zone can be used to assist in correction of the problems previously described. Alternatively, other substances capable of being fluid comprising high-boiling aromatic materials having a normal boiling point temperature above about 320 degrees F. such as, for example, anthracene oil, biphenyl, terphenyl and the like may be used instead of the deashed coal.

The deashed coal is melted, if necessary, to form a fluid and pumped under pressure into the plugged withdrawal conduit containing the heavy phase. The deashed coal mixes with the heavy phase and solids that have formed therein to form a mixture which exhibits fluid properties similar to those of the feed originally introduced into the separation apparatus. The exact composition of the mixture will depend upon the relative amounts of the components, however the deashed coal should comprise at least about 40 percent by weight of the mixture.

If the heavy phase withdrawal conduit is plugged in advance of the pressure reduction valve, after injection of the deashed coal, the mixture can be discharged through the pressure reduction valve and normal operation resumed.

If the plugging occurred at the pressure reduction valve in the heavy phase withdrawal conduit, block valves in the withdrawal conduit may be closed to isolate the plugged valve from the system without necessitating system depressurization. The plugged valve is removed, cleaned and reinstalled. Deashed coal then is introduced into the conduit and pressure reduction valve between the block valves and the block valves are reopened to permit normal operation to resume without replugging of the pressure reduction valve. Alternatively, additional deashed coal can be injected into the withdrawal conduit in advance of the first block valve to mix with the heavy phase and any solids that may be contained therein before reopening the block valves to resume normal operations.

In an alternate embodiment, when the system is to be depressurized and cooled for any reason, deashed coal is introduced through the conduit in which the feed normally flows into the separation zone to flush the heavy phase contained within the separation zone from the separation zone and out through the heavy phase withdrawal conduit. Such treatment eliminates the possibility of formation of unmeltable solids within the separation zone or heavy phase withdrawal conduit upon cooling and depressurization of the system.

DESCRIPTION OF THE DRAWING

The drawing schematically illustrates the process of this invention.

DESCRIPTION OF THE PREFERRED EMBODIMENT

Turning now to the drawing, during normal deashing process operations, a feed comprising coal liquefaction products is introduced into a mixing zone 12 through a conduit 10 from a source not shown. The coal liquefaction products comprise soluble coal products and insoluble coal products. The feed can be the product or any fraction thereof of any coal liquefaction process in which raw coal or other carbonaceous material is contacted with a liquefaction process solvent to solubilize a portion thereof to yield liquefaction products.

Solvent, flowing in a conduit 14 from a source not shown, is introduced into the mixing zone 12 to contact and mix with the feed material to form a feed mixture. Sufficient solvent is introduced into mixing zone 12 to provide a ratio by weight of solvent to feed in the feed mixture of from about 1:1 to about 10:1. It is to be understood that larger quantities of solvent can be used, however such use is uneconomical. The term "solvent" as used herein means a light organic solvent consisting essentially of at least one substance having a critical temperature below 800 degrees F. selected from the group consisting of aromatic hydrocarbons having a single benzene nucleus and normal boiling points below about 310 degrees F., cycloparaffin hydrocarbons having normal boiling points below about 310 degrees F., open chain mono-olefin hydrocarbons having normal boiling points below about 310 degrees F., open chain saturated hydrocarbons having normal boiling points below about 310 degrees F., mono-, di, and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs. The feed mixture is discharged from the mixing zone through a conduit 16 to enter a separation zone 18.

The separation zone 18 is maintained at an elevated temperature and pressure to effect a separation of the feed mixture into a light phase comprising soluble coal products and solvent and a heavy phase comprising insoluble coal products and some solvent which exhibits fluid-like properties under the conditions of the process. Preferably, the separation zone 18 is maintained at a temperature level in the range of from about 400 degrees F. to about 700 degrees F. and a pressure level in the range of from about 600 psig to about 1500 psig.

The separated light phase comprising soluble coal products and solvent is withdrawn from the separation zone 18 through a conduit 20 for introduction into subsequent downstream process apparatus (not shown). The downstream process apparatus separates the light phase into at least one stream comprising the soluble coal products (also referred to herein as deashed coal) and one other stream comprising solvent. The solvent stream can be recycled to the mixing zone 18 to aid in providing the feed mixture. The deashed coal is recovered and a portion can be used to produce the fluid-like mixture in the heavy phase withdrawal conduit to be described hereafter.

The separated heavy phase comprising insoluble coal products and some solvent is withdrawn from the elevated temperature and pressure separation zone 18 through a conduit 22 and a pressure reduction valve 24 interposed therein to enter subsequent downstream processing apparatus (not shown).

In the event the conditions within the separation zone 18 are not maintained within the predetermined limits, the heavy phase within the separation zone 18 and conduit 22 can become an undesirable solidified mass. The mass will deposit itself upon the inner surfaces of the separation zone 18 apparatus and the conduit 22. The solidified mass, once formed will not regain the desirable fluid-like properties of the heavy phase upon return of the process conditions to the predetermined limits. Further, the solidified mass has a tendency to spall away from the surfaces of the apparatus upon which it is formed. These fragments settle within the heavy phase and are withdrawn from the separation zone 18 through conduit 22.

If the fragments of solidified material are present in sufficient quantity the pressure reduction valve 24 in conduit 22 can be plugged by the solidified material or conduit 22 itself, may be plugged. In the past, when such plugging occurred, process operation was terminated, the system cooled and depressurized and the heavy phase solids were mechanically removed from the separation zone 18, conduit 22 and pressure reduction valve 24. Such process down-time is undesirable if an economical coal deashing process is to be achieved.

In accordance with the present invention, the discovery now has been made that the fluid-like properties of the heavy phase withdrawn from the separation zone can be maintained by introduction of deashed coal into the heavy phase withdrawal conduit. More specifically, in the event conduit 22 becomes plugged in advance of the pressure reduction valve 24, deashed coal is introduced at a pressure level above the pressure level in separation zone 18 into conduit 22 through a conduit 26, a valve 28 is interposed therein to regulate the flow of deashed coal into conduit 22. The deashed coal mixes with the withdrawn heavy phase and solids therein to form a mixture which exhibits fluid-like properties similar to those of the feed originally introduced into the separation apparatus. The exact composition of the mixture depends upon the relative amounts of the components, however the deashed coal should comprise at least about 40 percent by weight of the mixture. This mixture will then flow through the pressure reduction valve 24 and normal operation is resumed by terminating the flow of deashed coal into conduit 22.

Alternatively, the fluid substance can comprise a high-boiling aromatic compound having a boiling point temperature above about 310 degrees F. and one or more six membered nuclei, such as for example, anthracene oil, biphenyl, terphenyl and the like.

In the event the plugging occurs at pressure reduction valve 24, a block valve 30 and a block valve 32 (both normally open) interposed in conduit 22 on each side of valve 24 can be closed to seal the system and pressure reduction valve 24 can be removed and mechanically cleaned. The cleaned valve is reinstalled in the conduit 22 and deashed coal is introduced into the portion of conduit 22 between block valve 30 and pressure valve 24 through a conduit 34, a valve 36 being interposed therein to control the flow of deashed coal. The deashed coal is introduced into the conduit 22 at a pressure level substantially the same as the pressure level existing in conduit 22 in advance of block valve 30. The block valves 30 and 32 then are reopened and normal operation is resumed by terminating the injection of deashed coal into conduit 22. The withdrawn heavy phase and deashed coal flow through the pressure reduction valve 24 without the immediate replugging of the valve experience in the past when an attempt was made to maintain system operating conditions while a plugged valve was isolated, removed and cleaned. It is not necessary to depressurize and cool the system apparatus to permit normal operations to resume.

In the event conduit 22 and pressure reduction valve 24 both plug, block valves 30 and 32 are closed as previously indicated to seal the system and valve 24 is removed, cleaned and reinstalled. In this instance, deashed coal is introduced into conduit 22 through both conduits 26 and 34. The deashed coal mixes with the heavy phase and the solids that have formed therein to form the previously described mixture. Block valves 30 and 32 then are reopened and valves 28 and 36 closed to terminate introduction of the deashed coal into conduit 22.

Thus, the present invention provides a means by which it is possible to maintain the fluid-like properties of the heavy phase withdrawn from a separation zone maintained at elevated temperature and pressure. It is not necessary, as in the past, to terminate process operations, depressurize and cool the apparatus to permit cleaning of plugged apparatus. The solidified mass within the apparatus regains its previous fluid-like condition upon contacting and mixing with the deashed coal. The mixture then is capable of discharge without further plugging of the withdrawal conduit 22 or other downstream apparatus.

In an alternate embodiment, when it is desired to depressurize and cool the deashing system, for any reason, deashed coal is introduced into and through conduit 10 or 16 (means not shown) to flow through the separation zone 18 and heavy phase withdrawal conduit 22 to flush the heavy phase therefrom. Such treatment eliminates the possibility of formation of solids within the separation zone 18 and conduit 22 upon system depressurization. Thus, it is not necessary to disassemble the apparatus to mechanically remove the solidified heavy phase. This provides a more economical process as less maintenance time is required to maintain the deashing system in operational condition.

For the purpose of illustrating the present invention, and not by way of limitation, feed mixtures are prepared by mixing coal liquefaction products with a solvent comprising benzene in a ratio of about one part by weight of liquefaction products to about 5 parts by weight of benzene at a temperature level in the range of from about 400 degrees F. to about 700 degrees F. and a pressure level in the range of from about 700 psig to about 1000 psig. The coal liquefaction products were analyzed and found to have the analyses set forth in Table I below.

TABLE I

| | |
|---|---|
| Specific Gravity | |
| 60/60 | 1.34 |

TABLE I-continued

| | |
|---|---|
| Proximate Analyses | |
| % Loss at 105° C. | 0.4 |
| % Volatile Matter | 44.9 |
| % Fixed Carbon | 41.3 |
| % Ash | 13.4 |
| Ultimate Analyses | |
| % Carbon | 74.3 |
| % Hydrogen | 5.3 |
| % Nitrogen | 1.5 |
| % Sulfur | 2.0 |
| % Oxygen (diff.) | 3.5 |

The prepared feed mixtures then are utilized in various test runs to demonstrate the effectiveness of the present invention. The results of such test runs is described in greater detail in the following examples.

EXAMPLE I

Two test runs are set forth to illustrate the present invention. Specifically, one run is made in which pressure reduction valve 24 is intentionally plugged, isolated from the system by closing the block valves 30 and 32, removed, cleaned, reinstalled and nitrogen gas, at system pressure, is introduced into the conduit 22 between the block valve 30 and pressure reduction valve 24. The block valves 30 and 32 then are reopened an resumption of continuous operation is attempted. In the second run, the pressure reduction valve 24 is intentionally plugged, isolated, removed, cleaned and reinstalled as before however deashed coal is introduced into conduit 22 between block valve 30 and pressure reduction valve 24 at a temperature of about 500 degrees F. and a pressure of about 850 psig. Resumption of operation is again attempted (See FIG.).

In each instance the separation vessel 18 is maintained at a temperature level of about 500 degrees F. and a pressure level of about 850 psig. The plugging of pressure reduction valve is achieved by initiating a temporary system upset to cause the formation of solids in the heavy phase. In the first run in which no deashed coal was introduced into conduit 22, the pressure reduction valve 24 replugged immediately upon reopening block valves 30 and 32. By way of contrast, in the second run, in which deashed coal is introduced into conduit 22 between block valve 30 and pressure reduction valve 24, the block valves 30 and 32 are reopened and flow through conduit 22 and pressure reduction valve 24 is resumed without replugging.

EXAMPLE II

A single test is set forth to illustrate the ability of the present invention to return a plugged heavy phase withdrawal conduit to continuous operations.

The separation zone 18 is maintained at a temperature level of about 500 degrees F. and a pressure level of about 850 psig. The conduit 22 is intentionally plugged by initiating a temporary system upset to cause the formation of solids in the heavy phase. Deashed coal is introduced into conduit 22 at a temperature of about 500 degrees F. and a pressure of about 900 psig to mix with the heavy phase and solids in conduit 22. Upon mixing with the deashed coal, the heavy phase, and solids contained therein resumes its fluid-like properties and flows through conduit 22 and pressure reduction valve 24 without replugging.

The term "insoluble coal products" as used herein means undissolved coal, mineral matter, other solid inorganic particulate matter and other such matter which is insoluble in the solvent under the conditions of this invention.

The term "soluble coal products" or "deashed coal" means the constituents of the feed which are soluble in the solvent under the conditions of this invention.

It is to be understood that while certain apparatus such as valves and conduits has been particularly identified with respect to their relationship to the present invention, that other valves, pumps, and the like are also necessary to the operation of the deashing process, however, the proper selection of such apparatus is well within the ability and comprehension of those skilled in the art.

Further, while the present invention has been described in what at present are considered to be the preferred embodiments thereof, it is to be understood that changes or modifications can be made in the process or apparatus without departing from the spirit or scope of the invention as defined by the following claims.

What is claimed is:

1. A process for maintaining the fluid-like properties of a heavy phase withdrawn through a withdrawal conduit from a separation zone in a coal deashing process, said separation zone being maintained at elevated temperature and pressure to effect a separation of a feed mixture comprising soluble coal products, insoluble coal products and solvent, said solvent consisting essentially of at least one substance having a critical temperature below 800 degrees F. selected from the group consisting of aromatic hydrocarbons having a single benzene nucleus and normal boiling points below about 310 degrees F., cycloparaffin hydrocarbons having normal boiling points below about 310 degrees F., open chain mono-olefin hydrocarbons having normal boiling points below about 310 degrees F., open chain saturated hydrocarbons having normal boiling points below about 310 degrees F., mono-, di, and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs, said feed mixture being separated in said separation zone into a light phase and said heavy phase, which comprises:

(a) introducing a fluid substance into said withdrawal conduit during periods in which flow of said heavy phase through said conduit is interrupted due to conduit blockage by solids formed from said heavy phase to mix with said solids therein to form a mixture that exhibits fluid-like characteristics; and (b) discharging said mixture formed in step (a) through said withdrawal conduit without the necessity of depressurizing and cooling of said separation zone.

2. The process of claim 1 wherein said withdrawal conduit is defined further as including a pressure reducing valve and said conduit blockage is defined further as blockage of said pressure reduction valve in said withdrawal conduit and the introducing step is defined further by:

(a) isolating the blocked pressure reduction valve from said withdrawl conduit such that said pressure and temperature is maintained;

(b) removing the blocked pressure reduction valve from the withdrawal conduit;

(c) reinstalling a nonblocked pressure reduction valve in the withdrawal conduit;

(d) introducing said fluid substance into the withdrawal conduit at about said pressure in advance of said nonblocked pressure reduction valve to mix with any solids therein to form said mixture that exhibits fluid-like characteristics; and (e) returning said isolated nonblocked pressure reduction valve into active use in said withdrawl conduit.

3. The process of claim 1 in which the fluid substance is defined further as at least one member selected from the group consisting of deashed coal and aromatic compounds having a normal boiling point temperature above about 320 degrees F. and at least one six-membered nucleus.

4. The process of claim 1 in which the fluid substance introduced into the withdrawal conduit is defined further as introduced in sufficient quantity to comprise at least about 40 percent by weight of the mixture formed therein.

5. The process of claim 1 wherein the fluid substance introduced into the withdrawl conduit is defined further as deashed coal and the mixture formed by mixing of the deashed coal with the solids is defined further as comprising at least about 40 percent by weight of deashed coal.

6. The process of claim 1 in which the fluid substance introduced into the withdrawl conduit is defined further as at least one member selected from the group consisting of deashed coal and aromatic compounds having a normal boiling point temperature above about 320 degrees F. and at least one six-membered nucleus and in which the mixture formed comprises at least about 40 percent by weight of the fluid substance.

* * * * *